United States Patent [19]

Olsen

[11] Patent Number: 4,528,799

[45] Date of Patent: Jul. 16, 1985

[54] METHOD OF TRANSPORTING UNCURED RTV SILICONE RUBBER

[75] Inventor: Thomas O. Olsen, Sedgwick County, Kans.

[73] Assignee: Otto Fabric, Inc., Wichita, Kans.

[21] Appl. No.: 478,242

[22] Filed: Mar. 24, 1983

[51] Int. Cl.[3] ..... B65B 31/02

[52] U.S. Cl. ..... 53/432; 53/510

[58] Field of Search ..... 53/432, 403, 510, 474, 53/467

[56] References Cited

U.S. PATENT DOCUMENTS 3,498,798 3/1970 Baur et al. ..... 53/432

4,409,252 10/1983 Buschkens et al. ..... 53/432

*Primary Examiner*—Francis S. Husar

*Assistant Examiner*—Linda McLaughlin

*Attorney, Agent, or Firm*—Kokjer, Kircher, Bradley, Wharton, Bowman & Johnson

[57] ABSTRACT

A method of transporting uncured RTV silicone rubber is the subject of this invention. The silicone rubber is placed in a container and a quantity of argon gas is then added to the container before it is sealed to prevent escape of the gas.

1 Claim, No Drawings

METHOD OF TRANSPORTING UNCURED RTV SILICONE RUBBER

This invention relates generally to silicone rubber compositions and, more particularly, to a method of transporting uncured RTV silicone rubber.

Room temperature vulcanizing (RTV) silicone rubbers are by their very nature subject to reaction with the atmosphere to effect cross-linking and change from an uncured liquid to a cured solid. This causes problems in handling and transportation which have heretofore been met by shipping uncured RTV silicone rubber in containers with nitrogen gas occupying whatever capacity of the container is unoccupied by the silicone rubber. Nitrogen is readily available and relatively inexpensive but has one major disadvantage. It is lighter than air and, accordingly, will rise to the top of any container in which it is placed. This means that a sufficient quantity of nitrogen must be used so as to completely fill any voids in the container and, if for any reason an inadequate amount of nitrogen is supplied, there will be some oxidation of the material in the container.

This is a particular problem with RTV silicone rubber which readily reacts with the atmosphere. Heretofore, nitrogen gas has been used exclusively with RTV silicones. While argon is a known inert gas and has been used to protect various metals from oxidation, it has not heretofore been utilized in transporting RTV silicone rubber. It has been found that argon can be used as effectively as nitrogen for this purpose and holds several advantages over nitrogen. Argon, being heavier than air, will drop to the bottom of the void thus assuring that no reactive atmospheric gas will be in immediate contact with the material to be protected. Also, since the argon will always drop to the bottom of the container, it is not necessary to be as careful about completely filling the void in the container since any unfilled atmosphere above the argon will be of no consequence.

It is, therefore, a primary object of the present invention to provide an improved method of transporting uncured RTV silicone rubber by submerging the rubber in argon gas thereby assuring that the material will not react with the atmosphere and eliminating problems heretofore associated with nitrogen gas.

Other objects of the invention will be made clear or become apparent from the following description and claims.

The term "silicone rubber" as used in this application is meant to include any polysiloxane which has been cross-linked. Most silicone rubbers are predominantly methyl polysiloxane but the polymer may also contain other organic group substituents on the polymer chain such as phenyl or vinyl. Room temperature vulcanizing (RTV) silicones are all characterized by cross-linking at room temperature either through the addition of a catalyst or by moisture in the air. With the latter group of compounds, transporting of the silicone rubber is a particular problem. It is imperative that the uncured rubber be protected from the atmosphere so that it will not react with moisture in the air to cross-link and form a solid. RTV silicone rubbers are transported in airtight containers and, by utilizing a quantity of argon sufficient to cover the material present in the container, protection against reacting with the atmosphere is provided. The quantity of argon used is not critical so long as there is a sufficient amount present to completely cover the amount of material present. The container is then sealed to prevent escape of the argon gas. Since argon is heavier than air, it will drop to the bottom of the unoccupied portion of the container. Even if all of the empty space in the container is not occupied by the inert gas, it will continue to function in the proper manner so long as it covers the material being transported.

I claim:

1. A method of protecting uncured RTV silicone rubber, said method comprising submerging said silicone rubber in a container and placing argon over said silicone rubber.

* * * * *